United States Patent [19]

Glotin et al.

[11] 4,105,279

[45] Aug. 8, 1978

[54] REMOVABLE DOWNHOLE MEASURING INSTRUMENTS WITH ELECTRICAL CONNECTION TO SURFACE

[75] Inventors: Bernard J. P. Glotin, Saint Maur; Andre J. Guimard, Le Mee sur Seine, both of France

[73] Assignee: Schlumberger Technology Corporation, New York, N.Y.

[21] Appl. No.: 856,717

[22] Filed: Dec. 2, 1977

Related U.S. Application Data

[60] Continuation of Ser. No. 751,419, Dec. 16, 1976, abandoned, which is a continuation of Ser. No. 615,145, Sep. 19, 1975, abandoned, which is a division of Ser. No. 447,443, Mar. 1, 1974, Pat. No. 3,939,705.

[51] Int. Cl.[2] ..... H01R 3/04

[52] U.S. Cl. ..... 339/117 R; 339/94 R

[58] Field of Search ..... 339/94, 96, 117

[56] References Cited

U.S. PATENT DOCUMENTS

| | | | |
|---|---|---|---|
| 3,059,210 | 10/1962 | Luenberger | 339/94 R |
| 3,378,811 | 4/1968 | Cullen et al. | 339/96 |
| 3,398,392 | 8/1968 | Henderson | 339/117 R |
| 3,491,326 | 1/1970 | Pfister et al. | 339/94 C |
| 3,604,964 | 9/1971 | Conrad et al. | 339/94 R |
| 3,641,479 | 2/1972 | O'Brien et al. | 339/94 R |
| 3,729,699 | 4/1973 | Briggs et al. | 339/94 R |
| 3,736,548 | 5/1973 | Double | 339/94 A |
| 3,753,206 | 8/1973 | Busuttil et al. | 339/117 R |

*Primary Examiner*—Joseph H. McGlynn
*Attorney, Agent, or Firm*—David L. Moseley; William R. Sherman; Edward M. Roney

[57] ABSTRACT

In accordance with an illustrative embodiment of the present invention, a hollow mandrel mounted in a production string has an eccentrically disposed, lateral recess adapted to receive a measuring instrument. A plug-in contact assembly is located at the lower end of the recess and is connected to an electric cable which is fixed to the outside of the production string. The measuring instrument includes a receptacle assembly on its lower end which is fitted onto the contact assembly during emplacement of the instrument in the recess, thereby to provide in combination with the cable an insulated electric connection between the measuring instrument and the surface. The measuring instrument can be placed into, or removed from, the recess as desired, for example by means of conventional running and pulling tools that are lowered into the production string at the end of a wireline.

7 Claims, 9 Drawing Figures

FIG. 1
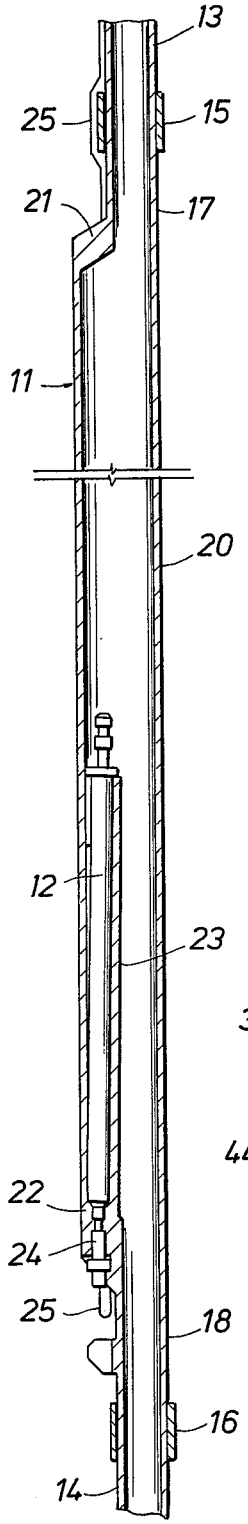
FIG. 2
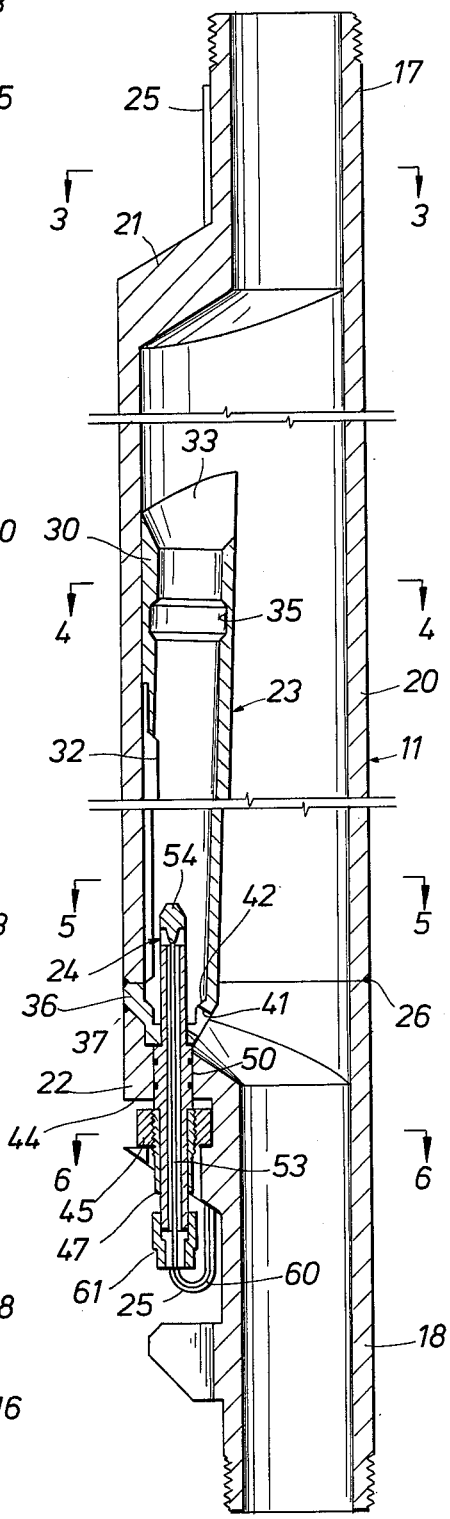
FIG. 3
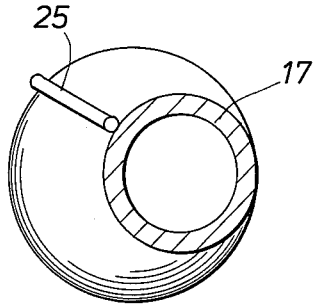
FIG. 4
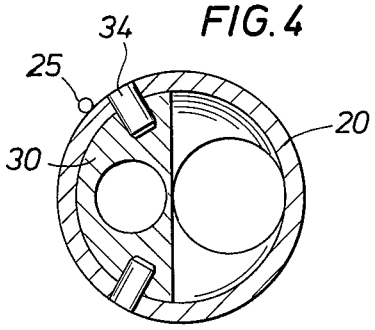
FIG. 5
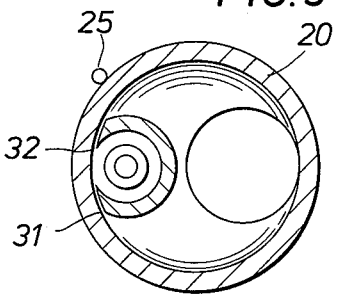
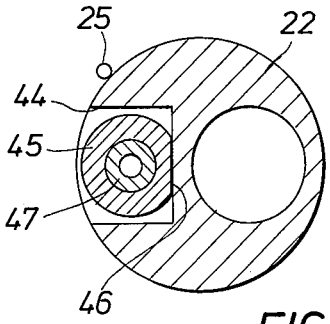
FIG. 6

REMOVABLE DOWNHOLE MEASURING INSTRUMENTS WITH ELECTRICAL CONNECTION TO SURFACE

This is a continuation of application Ser. No. 751,419, filed Dec. 16, 1976, now abandoned, a continuation of application Ser. No. 615,145 filed Sept. 19, 1975 now abandoned, a division of application Ser. No. 447,443, filed Mar. 1, 1974, now U.S. Pat. No. 3,939,705.

This invention relates to measuring instruments adapted to be installed in producing wells.

Certain measuring instruments, such as pressure gauges, for example, often are installed permanently in wells. Such instruments make it possible to measure and record changes in downhole pressure as the well is produced. Such an instrument may be connected by an electric cable to a surface equipment that furnishes the electric power necessary for the measurement, as well as displaying and sometimes recording the downhole information. The measuring instrument and its cable normally are attached on the exterior of the production string. In case of failure, or if it is desired to carry out adjustment or maintenance operations, it is therefore necessary to remove the production string from the well in order to recover the instrument. Such an operation is clearly time consuming and costly, especially since the electric cable is difficult to re-utilize, even if it were still in good condition prior to the removal of the production string.

One object of the present invention is to provide a new and improved measuring instrument and apparatus for installing the instrument in a production string in such a manner that the measuring instrument can be brought up to the surface and reinstalled without removing the production string from the well.

Equipment and apparatus for installing and removing valves at different levels of a production string, as required, are well known. These valves commonly called "gas lift" valves are used to open and close lateral passages between the exterior and the interior of the production string, thereby making it possible to inject gas into the string at the desired depths. U.S. Pat. No. 2,679,903 describes such an installation which includes a plurality of eccentric hollow mandrels, each of which is arranged with a lateral recess capable of receiving a valve. The valve is installed or removed from its recess by means of typical running and pulling tools lowered into the well at the end of a flexible carrying line and capable of implanting the valve in the recess. Heretofore, however, such mandrels have been designed only for the installation of mechanical equipment such as valves.

Another object of the present invention to provide a new and improved instrument installation which makes it possible to install in a production string a device utilizing an electrical connection with the surface.

These and other objects are attained in accordance with the concepts of the present invention through the provision of apparatus including a hollow mandrel having two end parts adapted for connection to a production string and a middle part of larger section than the end parts, the said mandrel further having a lateral recess arranged within the middle part. An electric cable is attached on the exterior of the mandrel and extends up to the surface along the production string. At one end of the lateral recess is arranged a contact assembly providing an electric link between the cable and the measuring instrument when the latter is in place within the recess. The contact assembly includes a conductor arranged in an insulating sleeve which goes through a wall of the mandrel in a sealed manner. The conductor and the insulating sleeve have respective surfaces which coact with the parts of the measuring instrument to provide an electric connection which is insulated from well fluids. When the measuring instrument is not in its recess, the said surfaces of the conductor and insulating sleeve are immersed in the well fluids.

The measuring instrument includes a housing capable of being introduced into the lateral recess and containing a measuring assembly for producing an electric signal on an output terminal. The output terminal is electrically connected to a connector receptacle adapted to engage the contact surface of the mandrel conductor when the measuring instrument is emplaced within the recess. The measuring instrument also comprises means for insulating the electric contact thus formed from the well fluids. The insulating means includes an insulating flexible sheath arranged around the connector and capable of bearing on the contact surface of the insulating sleeve, thereby providing, around the connector and the conductor, which may be in the form of an elongated rod, a closed chamber not in contact with the fluids of the well. Owing to the flexibility or elasticity of the sheath, this chamber can deform and decrease in size when the receptacle is being removed from the plug assembly.

These and other features and advantages of the invention will be better understood from the following description and the accompanying drawings in which:

FIG. 1 is a longitudinal sectional view of a production string having a mandrel according to the invention in which is placed a measuring instrument;

FIG. 2 is an enlarged sectional view which represents in greater detail the mandrel of FIG. 1;

Figure 7A:
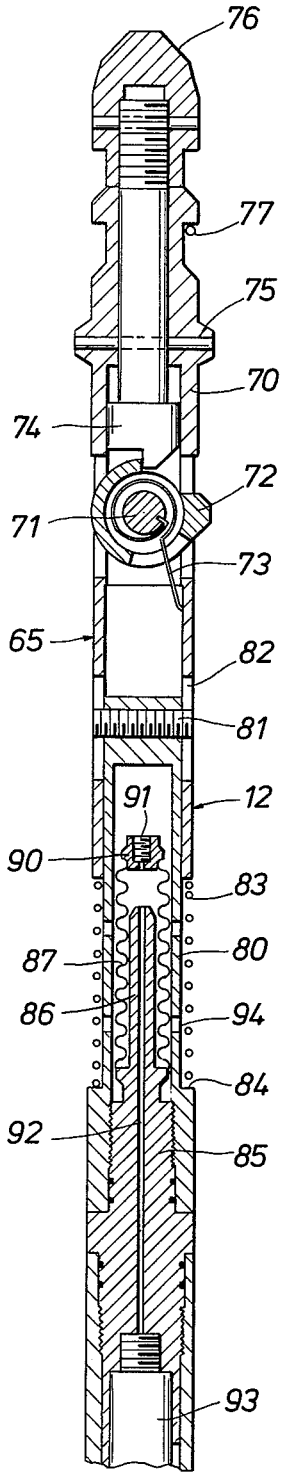
Figure 7B:
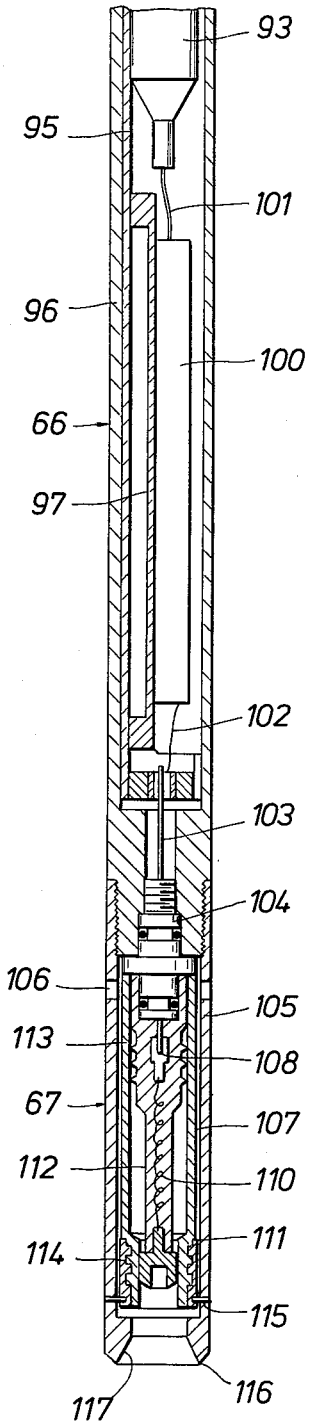
Figure 8:
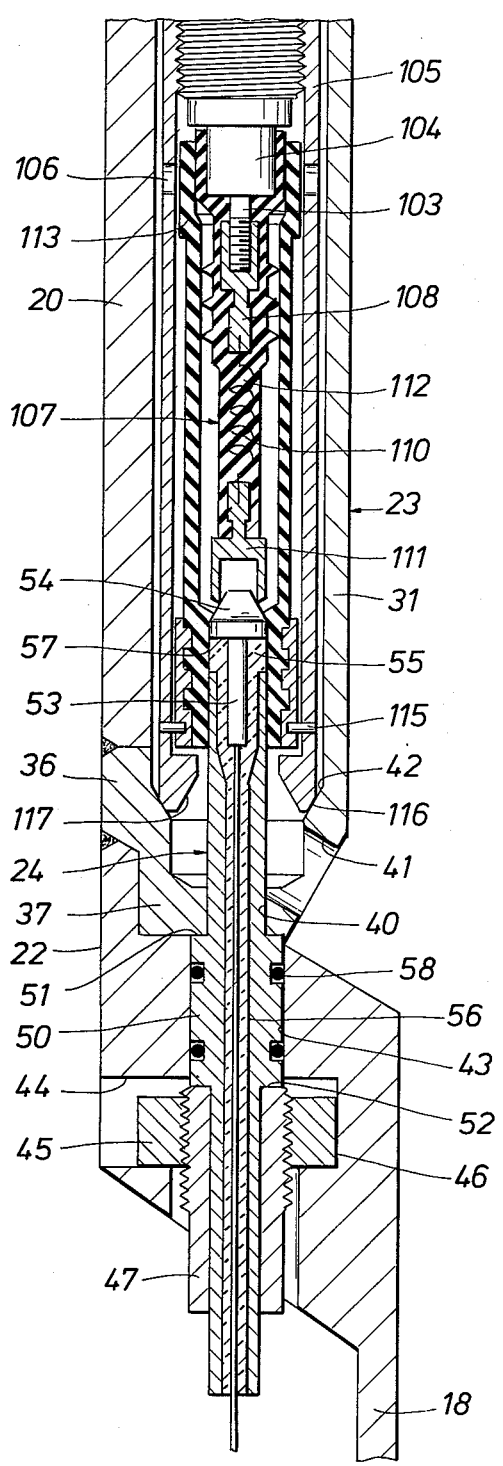

FIGS. 3, 4, 5 and 6 are cross sections of the mandrel taken along the lines 3—3, 4—4, 5—5 and 6—6 respectively of FIG. 2;

FIGS. 7A and 7B are longitudinal sectional views of a measuring instrument according to the presention invention; and FIG. 8 is a longitudinal section view representing in greater detail the electric connection between the mandrel and the measuring instrument.

Referring to FIG. 1, a mandrel 11 adapted to receive a measuring instrument 12 is connected at the desired depth in a production string of tubing or the like, of which two sections 13 and 14 adjacent to the mandrel 11 have been shown. The connections between the mandrel 11 and the adjacent elements are made by conventional threaded collars 15 and 16. The mandrel 11 comprises two end parts 17 and 18 having generally the same section as the production string, and a middle eccentric part 20 with a larger internal section, connected to the end parts by partitions 21 and 22 of conical form. The middle part 20 has arranged therein a lateral recess 23 which still allows a longitudinal passage through the mandrel, of a section at least equal to that of the production string. At the lower end of the lateral recess 23, in which is placed the measuring instrument 12, a contact or plug assembly is provided. The plug assembly extends through the wall of the mandrel and is connected to a cable 25 fixed on the exterior of the mandrel and extending up to the surface along the production string. When the measuring instrument 12 is in place in the recess 23, the plug assembly 24 provides an insulated electric connection between the measuring instrument and the cable 25, thereby allowing the supply of power to the instrument, as well as the transmission of information to the surface.

The mandrel 11, shown in greater detail in FIGS. 2 to 6, is made up, for example, of two machined elements butt welded at 26, the lateral recess 23 being an added-on piece attached by its ends to the interior of the middle part 20. Other embodiments are possible, of course, for example, forged blanks. The lateral recess 23, slightly inclined with respect to the axis of the production string, comprises an upper part 30 of semicircular section (FIG. 4) and a lower part 31 of tubular form having a longitudinal cut 32 (FIG. 5). The upper part 30, which has a tapered entry 33 to facilitate the introduction of the measuring instrument, is attached to the body of the mandrel by screws 34 (FIG. 4) sealed by welding. An annular groove 35, cut in the internal face of the upper part 30, makes it possible to secure the measuring instrument in its recess as will be described further below. The lower part 31 of the recess 23 (see also FIG. 8) which has a boss 36 welded between the central part 30 and the end part 18 of the mandrel, terminates downwardly in a transverse wall 37 pierced with a longitudinal bore 40 and an oblique hole 41. Immediately over the transverse wall 37 is made a tapered internal bearing surface 42 having a stainless conducting coating, of rhodium for example, arranged to be engaged by the lower end of the measuring instrument as will be described in further detail below.

Concentric with the axis of the bore 40, another bore 43 with a diameter larger than the first, goes through the conical partition 22 of the mandrel. A rectangular slot 44 (FIG. 6) opens toward the outside of the mandrel and may be cut transversely in the partition 22. This slot receives a nut 45 that is stopped from rotating with respect to the mandrel by a flat surface 46. A threaded sleeve 47, screwed in the nut 45, keeps the plug assembly 24 in place in the bore 43.

The contact or plug assembly 24 has a tubular metallic body 50 with a shoulder 51 which bears against the lower side of the transverse wall 37, and a shoulder 52 which bears against the sleeve 47. A conducting rod 53, comprising a head 54 having a conical upper contact surface, is sealed by a glass sleeve 55 within a bore 56 which extends longitudinally through the body 50. The metals chosen for the conducting rod and the body 50, in a preferred form, should have an expansion coefficient as close as possible to that of the glass 55.

The glass sleeve 55 has at its upper end portion an annular contact surface 57 located even with the external surfaces of the body 50 and the head 54. Seals 58 prevent fluid leakage between the body 50 and the mandrel. The conducting rod 53 is connected, at its lower end, to a conductor 60 of the cable 25 by means of a sealed fitting 61 of a conventional type (FIG. 2).

This arrangement gives the contact assembly 24 excellent resistance to the severe environmental conditions (temperature, pressure, shocks, corrosive fluids) which may be encountered in wells. This resistance is all the more valuable as the assembly remains constantly in the well and can be replaced only by withdrawing the production string. In spite of its apparent simplicity, this contact assembly performs a double function. Firstly, it constitutes a sealed cross-over through the wall of the mandrel. Secondly, provision of separate upper surfaces, one of which conducts and the other insulates, it is possible to provide an insulated electric connection with the measuring instrument in an electrically conductive medium.

FIGS. 7A and 7B represent the measuring instrument 12 which comprises, from top to bottom, a locking assembly 65, a measurement assembly 66 and an electrical connection assembly 67. The locking assembly 66, of a conventional type, is intended to keep the measuring instrument secured in the lateral recess of the mandrel while cooperating with the groove 35. This locking assembly is similar to those generally used for the installation or removal of valves as described in the previously-mentioned United States patent. Within the body 70 a latch 72 is rotatingly mounted on a pivot 71 and loaded clockwise by a spiral spring 73. A locking rod 74 held in the body by a pin 75 prevents the latch 72 from moving downward beyond the position shown in FIG. 7A.

When the measuring instrument is introduced into its recess, the latch 72 is driven upward until it is opposite the groove 35 in which it engages. The locking rod 74 prevents the latch 72 from moving downward, holding the measuring instrument in its recess.

A retrieval head 76 is screwed onto the upper part of the locking rod 74. To remove the instrument from the pocket, a pulling tool is engaged on the head 76, and the head is pulled upward so as to shear the pin 75. The rod 74 then moves upward and frees the latch 72. The measuring instrument is then no longer maintained in the recess 23 and can be brought up to the surface.

The locking assembly 65 also comprises, at its lower part, a telescoping device making it possible to dampen the shocks transmitted by this locking assembly to the measurement assembly during the installation or removal of the instrument, and to keep the connection assembly 67 firmly against the conical bearing surface 42. At the lower part of the body 70 is slidingly mounted a tube 80 whose stroke is limited by a pin 81 attached to the upper part of the tube 80, the pin being movable within diametrically opposed longitudinal grooves 32 cut in the body 70. A spring 83 compression-mounted between a shoulder 84 of the tube 80 and the lower face of the body 70 drives the tube 80 downwardly with respect to the body.

The tube 80 is screwed onto a coupling 85 which forms part of the measurement assembly 66, in this example a manometer or pressure gauge. The coupling 85 extends upwardly through a column 86 surrounded by a bellows 87 which terminates at its upper part in a cap 90 equipped with a filling plug 91. The column 86 is pierced with a longitudinal passage 92 filled with oil, as is the interior of the bellows 87. The pressure of the oil contained in the passage 92 is applied to a pressure sensor 93 screwed at the lower part of the coupling 85. The pressure of the fluids outside of the instrument is transmitted to the bellows 87 through lateral openings 94 traversing the tube 80. The coupling 85 extends downward by a tubular support 95 placed within a sealed envelope 96 itself screwed onto the coupling 85.

A base 97, fixed on the support 95, carries electronic circuits represented schematically by the block 100. The electronic circuits 100 are connected, on the one hand, to a sensor 93 by means of conductors 101 and, on the other hand, by means of a conductor 102, to the conducting rod 103 of a sealed bushing 104 screwed into the lower part of the housing 96. The sensor 93 can consist, for example, of a pressure-deformable diaphragm on which are fixed strain gages which are bridge connected and supplied with direct current. The ouput signal of the sensor 93 is applied to the electronic circuits 100 which may include voltage-frequency converter whose output signal can be superimposed on the DC power supply of the sensor. This arrangement makes it possible to provide a measurement assembly having a single output terminal.

The connection assembly 67, also represented in FIG. 8, comprises a carrying tube 105 screwed into the lower part of the housing 96 and provided with lateral opening 106. The sealed bushing 104 is integral with a connector 107 located in the tube 105. On the lower part of the conducting rod 103 is screwed a metallic ring 108 to which is attached a helical conductor wire 110 forming a spring whose lower end is connected with a contact cup 111. The cup 111, the conductor 110, the ring 108 and part of the sealed bushing 104 are encased in an elastomer 112. The cup 111 can thus move longitudinally to some extent within the tube 105.

The connection or receptacle assembly 67 also comprises means for insulating the electrical contact between the cup 111 and the head 54 from the well fluids. An insulating flexible duct 113 which fits closely around the upper part of the elastomer 112 has a thicker lower part integral with a metallic bushing 114. The bushing 114, mounted with a large clearance within the tube 105, is maintained longitudinally by pins 115 which go through the wall of the tube. The lower face of the tube 105 has a conducting and stainless external conical surface 116 adapted to bear on the complementary conical bearing surface 42 of the recess 23 (FIG. 8) to form an electrical contact for ground. An internal chamber 117 guides the tube 105 onto the contact assembly 24.

It will be noted that in the extended position (FIG. 7B) the cup 111 blocks the lower end of the duct 113 leaving only a small space between the cup and the internal face of this duct. The volume included between the elastomer 112 and the duct 113 can thus be filled with a viscous insulating fluid, liquid silicone for example, during the lowering of the measuring instrument in the production string. After the installation of the measuring instrument in the lateral recess, and even if conducting fluids have penetrated into this space, the contact head 54 and the cup 111 are insulated from the tube 105 and from the well fluids by the duct 113 whose inner face, located within the bushing 114, bears on the contact surface 57 of the insulating sleeve 55.

When it is desired to perform measurements with an instrument permanently installed in a production well, a mandrel 11, as represented in FIG. 2, is connected in the production string at the desired depth. The lateral recess 23 is equipped with the contact assembly 24 connected to the cable 25 which is fixed along the exterior of the production string as it is lowered into the borehole. The measuring instrument then can be installed in the lateral recess 23. It will be noted that the cuttings which may have accumulated in the lateral recess 23 are removed through the oblique hole 41.

For the installation, a conventional running tool is used, for example a tool of the type described in U.S. Pat. No. 2,679,903. the measuring instrument 12 is fixed in the position represented in FIGS. 7A and 7B, at the lower end of this tool, by means of a pin 77, and the assembly is lowered into the production string down to the level of the mandrel at the end of a flexible line. An upward movement followed by a downward movement positions the measuring instrument toward the lateral recess 23. The measuring instrument is then lowered into its recess until the latch 72 engages in the groove 35. When the measuring instrument in fully fitted in its recess, the contact assembly 24 enters the lower part of the flexible duct 113 and the contact is established between the head 54 and the cup 111 of the connector 107. The fluid located within the duct 113 is driven upward and escapes by passing between the upper part of this duct and the elastomer 112. The duct 113 bears on the contact surface 57 of the glass sleeve 55 and forms, around the head 54 and the contact 111, a closed chamber which insulates this contact from the well fluids. The instrument running tool is then freed by shearing the pin 77, and the tool is raised to the surface. The instrument 12 is then ready to operate when it is supplied with current through the cable 25.

If it is desired to perform adjustment, maintenance or repair operations on the measuring instrument, it can be removed from the recess 23 and brought up to the surface by means of a pulling tool similar to the running tool as will be apparent to those skilled in the art. The pulling tool, lowered into the production string by means of a flexible line, hooks onto the retrieval head 76. By pulling the line upward, the pin 75 which frees the latch 72 is sheared. The instrument 12 can thus be removed from the pocket. The suction effect which occurs when the plug assembly 24 is removed from the duct 113 results in a radial crushing of the duct which is of course possible due to the compliant nature thereof. The internal volume of the duct 113 is sufficiently large to allow the contact assembly 24 to be readily removed from the duct. The measuring instrument can then be brought up to the surface by means of the flexible line for the necessary operations and then reinstalled as previously discussed.

The measuring instrument is thus accessible without withdrawing the production string. The elements remaining permanently in the well, and in particular the contact assembly 24 and the cable 25, are extremely simple and highly resistant to corrosion. On the other hand, all the mobile or more delicate elements are placed in the measuring instrument which can be brought up to the surface easily. The measuring instrument installation or removal operations are carried out simply by means of conventional equipment currently used in the production of wells.

The apparatus just described can involve many variants, in particular with regard to technical design details and the materials used. In particular, the instrument capable of being placed in the mandrel can be other than a pressure gauge, since the locking and electrical connection assemblies are easily adaptable to different types of electrically operated measuring devices. It is thus possible to use other installation or withdrawal techniques using tools moved by pumping fluids through the production string. Since it will be apparent that various modifications and changes may be made without departing from the inventive concepts involved, it is the aim of the appended claims to cover all such changes or modifications falling within the true spirit and scope of the present invention.

We claim:

1. Apparatus adapted for the installation of an instrument in a well, comprising: an elongated hollow mandrel; means at each end of said mandrel arranged for connection to a production string, said mandrel having a vertical main bore extending therethrough; means in said mandrel located to the side of said main bore forming an elongated pocket having a longitudinal axis offset from said main bore and adapted to receive an instrument, the upper end of said pocket opening to the interior of said mandrel and communicating with said bore intermediate the ends of said mandrel; an opening through the wall of said mandrel into the lower end of said pocket, said opening extending to the exterior of said mandrel and being axially aligned with said longitudinal axis; and an electrical contact assembly extending through said opening and being sealably fixed to said mandrel, said contact assembly providing contact means projecting into said pocket at the lower end thereof for providing an insulated electrical connection between an instrument implanted in said pocket and an electrical cable located externally of said mandrel.

2. The apparatus of claim 1 wherein the said cable extends up to the surface along the exterior of said production string.

3. The apparatus of claim 1 wherein the said contact assembly comprises an elongated conductive element fitted within an insulating sleeve means, said conductive element having a first contact surface adapted to be engaged by a connector means of an instrument, said insulating sleeve means providing a second contact surface around said conducting element adapted to be engaged by means on an instrument for insulating the said first contact surface from the well fluids.

4. The apparatus of claim 3 wherein the said insulating sleeve means includes a tubular body mounted around said conductive element, and a glass seal element between said tubular body and said conductive element.

5. The apparatus of claim 4 wherein the said second contact surface of said insulating sleeve means has the same radial dimension as the adjacent external surface of said tubular body.

6. A connector assembly comprising: contact means adapted to be fixed in an upstanding position in a well tubing, said contact means having first and second surfaces, one of which is conductive and the other of which is insulative; a connector body having an open lower end portion adapted to fit over said contact means; connector means including an elongated resilient member suspended within said body and having a contact element at its lower end adapted to bear on said one surface; and an insulating flexible duct located within said body and surrounding said connector means, said duct having an upper portion engaging said connector means and a lower portion fixed against longitudinal movement relative to said body and adapted to bear on said other surface, said duct having an intermediate portion spaced laterally from said resilient member to provide a closed chamber around said connector means and said one surface that is insulated from well fluids, said upper portion of said duct bearing elastically on said connector means in such a manner as to allow a fluid contained in said chamber to escape when said duct is fitted onto said contact means.

7. A connector assembly comprising: contact means fixed in an upstanding position in a well tubing, said contact means having first and second surfaces, one of which is conductive and the other of which is insulative; a connector body having a lower end portion adapted to fit over said contact means; conductive means within said body adapted to bear on said one surface; and an insulating flexible duct arranged around said conductive means and adapted to bear on said other surface, said duct providing a closed chamber around said conductive means and said one surface that is insulated from well fluids, said duct bearing on said other surface of said contact means adjacent one end of said duct, said one end being fixed to said connector body, the other end portion of said duct bearing elastically on an insulation means provided around said conductive means in such a manner as to allow a fluid contained in said chamber to escape when said duct is fitted onto said contact means, said conductive means comprising a contact element movable vertically within said duct and engageable with said one end thereof in a manner to block said one end and thereby retain an insulating fluid within said chamber.

* * * * *